United States Patent [19]

Herz

[11] 4,151,982

[45] May 1, 1979

[54] APPARATUS FOR CLEANING METALLURGICAL VESSELS SUCH AS SLAG POTS AND LADLES

[75] Inventor: Alvin E. Herz, Lakeland, Fla.

[73] Assignee: L. B. Foster Company, Carnegie, Pa.

[21] Appl. No.: 807,879

[22] Filed: Jun. 20, 1977

[51] Int. Cl.[2] ..... F27D 23/02

[52] U.S. Cl. ..... 266/135; 15/94; 74/87; 134/1; 248/674; 266/287; 366/114

[58] Field of Search ..... 259/DIG. 41, DIG. 42, 259/DIG. 43, DIG. 44; 15/94; 134/1, 16, 17; 269/238; 266/135, 287; 366/110, 111, 112, 114; 248/2, 14; 74/87; 310/81

[56] References Cited

U.S. PATENT DOCUMENTS

| | | | |
|---|---|---|---|
| 1,762,416 | 6/1930 | Pickop | 259/DIG. 43 |
| 1,774,612 | 9/1930 | Pickop | 259/DIG. 43 |
| 2,185,850 | 1/1940 | Jackson | 259/DIG. 42 |
| 2,550,534 | 4/1951 | Damond | 259/DIG. 42 |
| 3,482,830 | 12/1969 | Sendoykas | 269/238 X |
| 3,638,269 | 2/1972 | Campbell | 15/94 |
| 3,915,436 | 10/1975 | Matson | 259/DIG. 43 |

*Primary Examiner*—Philip R. Coe

*Attorney, Agent, or Firm*—Buell, Blenko & Ziesenheim

[57] ABSTRACT

Method and apparatus are provided for cleaning metallurgical vessels such as slag pots, ladles and the like by inducing vibration into such vessel from a housing clamped to said vessel and containing a vibratory means such as rotating eccentric weights.

9 Claims, 4 Drawing Figures

APPARATUS FOR CLEANING METALLURGICAL VESSELS SUCH AS SLAG POTS AND LADLES

This invention relates to methods and apparatus for cleaning metallurgical pots and ladles and particularly to a vibratory apparatus for attachment to slag pots and ladles and to a method of removing solidified slag, metal and refractory materials from the interior of such vessels.

Slag pots, molten metal ladles and the like are subject to the accumulation of solidified slag and metal within the interior caused by cooling and solidification of the molten contents of such vessels generally known as "skull" and at times by the accidental cooling of a full ladle of such materials. In addition, most molten metal ladles are lined with a refractory shell either in the form of a rammed refractory or in the form of brick which must be removed and replaced from time to time. The removal of these skulls and refractory linings has been a tedious and time consuming job generally done with air hammers and cutting torches.

I have developed a novel apparatus and method by which these internal accretions and linings can be removed in a matter of minutes. I accomplish this by inducing vibration into the pot or ladle which carries through the entire body of the ladle or pot and causes it to separate from the lining and/or accretions.

I provide a housing, clamp means on the housing adapted to engage a metallurgical vessel and vibratory means in said housing adapted to induce vibratory motion in the housing and vessel to separate accretions from the vessel walls. Preferably the clamp means engages the top lip of the vessel. Preferably the vibratory means is made up of eccentric weights rotated by hydraulic fluid from a hydraulic pressure source and the clamp means is actuated from the same hydraulic source. The vibratory means could, of course, be electrically operated or mechanically operated. Means are preferably also provided for locking the slag pot or ladle onto its carrier frame at the same time the housing is clamped to the vessel edge.

In the foregoing general description of this invention certain objects, purposes and advantages have been outlined. Other objects, purposes and advantages of this invention will be apparent from a consideration of the following description and the accompanying drawings in which.

Figure 4:
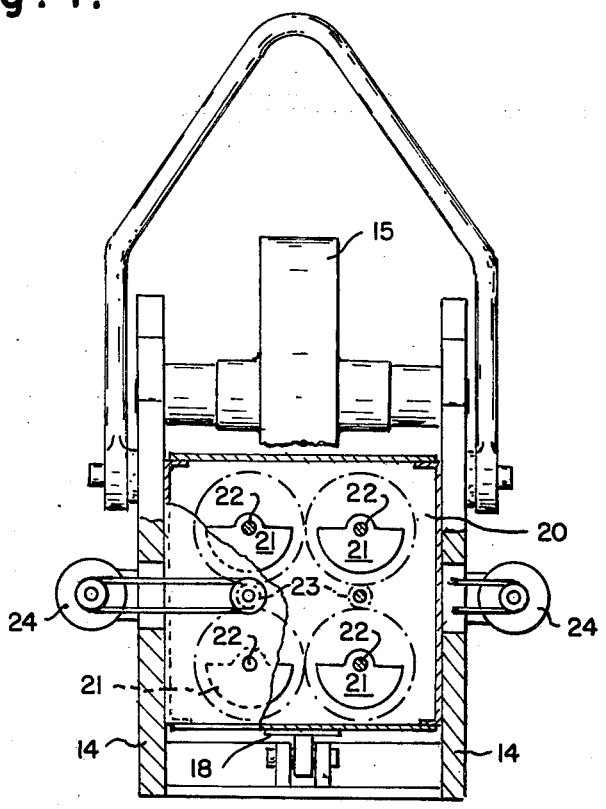
FIG. 4 is a front elevational view of the apparatus, partly cut away showing a rotary eccentric type vibratory assembly driven by either hydraulic or electric drive motors.

Referring to the drawings, I have illustrated a slag pot 10 having a top rim edge 11, a reenforcing and locking ring 12 and a carrying cradle 13. A housing 14 has at one end a clamping member 15 pivoted intermediate its ends on pin 16. The clamping member 15 is provided at one end with a hook **15*a* adapted to engage the rim edge 11 of the slag pot and draw it tightly against housing 14 and at the other end with a pivot pin 15*b* engaged by a hydraulic piston 17 operated by cylinder 18. At the other end of housing 14 is a depending finger 19 which engages beneath the carrying cradle 13 so that when clamp member 15 is locked onto rim edge 11 the slag pot 10 is positively fixed onto the cradle so as to prevent accidental separation of the slag pot 10 from the cradle 13. A vibratory assembly 20 operated by hydraulic fluid is mounted in housing 14 so that housing 14 and clamp member 15 transmit its vibratory effects to the rim edge 11 of slag pot 10. The preferred vibratory assembly 20 as shown is of the rotary eccentric type such as shown in LeBelle U.S. Pat. No. 3,433,311 using hydraulically operated drive motors. Other vibratory assemblies can, of course, be used instead of the hydraulically operated structure described. However, the hydraulically operated unit is particularly suited to be sequentially connected to hydraulic cylinder and piston 17 and 18. In FIG. 4, I have illustrated a vibrator of the rotary eccentric type of U.S. Pat. No. 3,433,311 using eccentric weights 21, on shaft 22 which turns with gear 23 driven by motor 24**, which motor may be electric or hydraulic.

Figure 1:
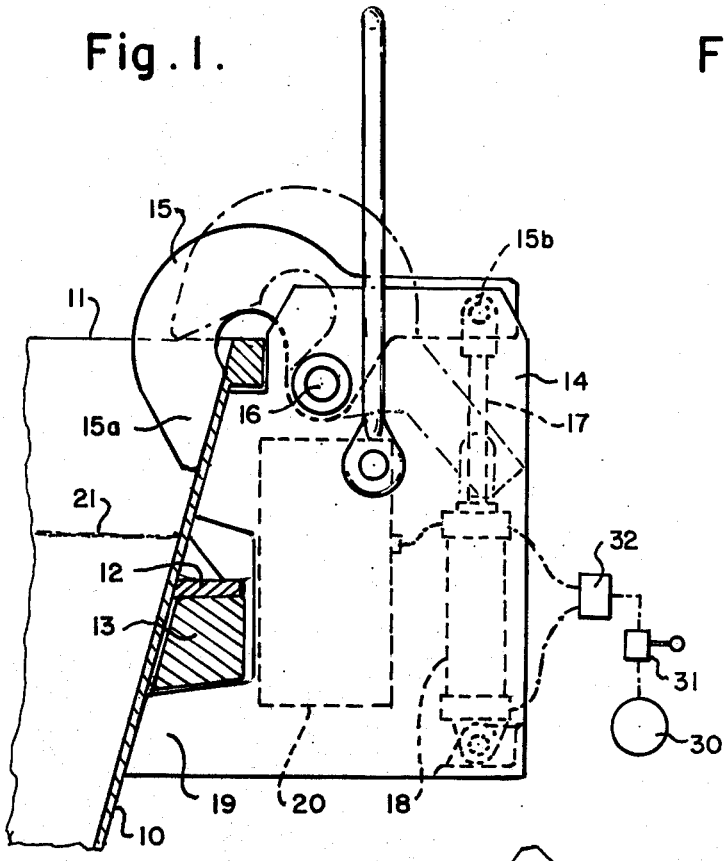
FIG. 1 is a side elevational view of one embodiment of cleaning apparatus according to this invention.
Figure 2:
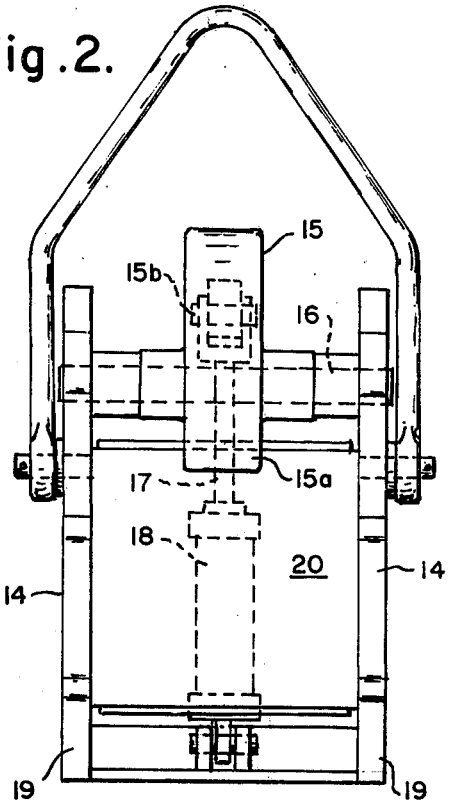
FIG. 2 is a front elevational view, from the left of FIG. 1 of a cleaning apparatus according to the invention.

In a preferred operation, I place housing 14 on the edge 11 of slag pot 10 with depending finger 19 behind the cradle 13. The cylinder 18 is then actuated by hydraulic pressure from source 30 then manual valve 31 to move clamp member 15 from the chain line position of FIG. 1 to the solid position of FIG. 1. When the hook **15*a* has engaged the rim firmly, a sequencing valve of conventional form 32 transfers the flow of hydraulic fluid from cylinder 18 to vibratory assembly 20 which immediately induces vibratory motion through housing 14 and clamp 15 into the rim edge 11 of the slag pot 10 causing the body of the slag pot to separate from any foreign material, such as slag skull 21, which has become attached to it. Generally where such foreign material is slag or refractory it is caused to break up into readily handleable pieces which may be simply dumped from pot 14**.

When it is desired to stop the unit and remove it the flow of hydraulic fluid is simply diverted back to the opposite side of cylinder 18 to open clamp 15. Preferably the manual hydraulic valve 31 is spring loaded to return to a normal position which diverts the fluid from the vibratory assembly to cylinder 18 for opening clamp 15 thus in effect providing a "dead man" control for the unit.

Figure 3:
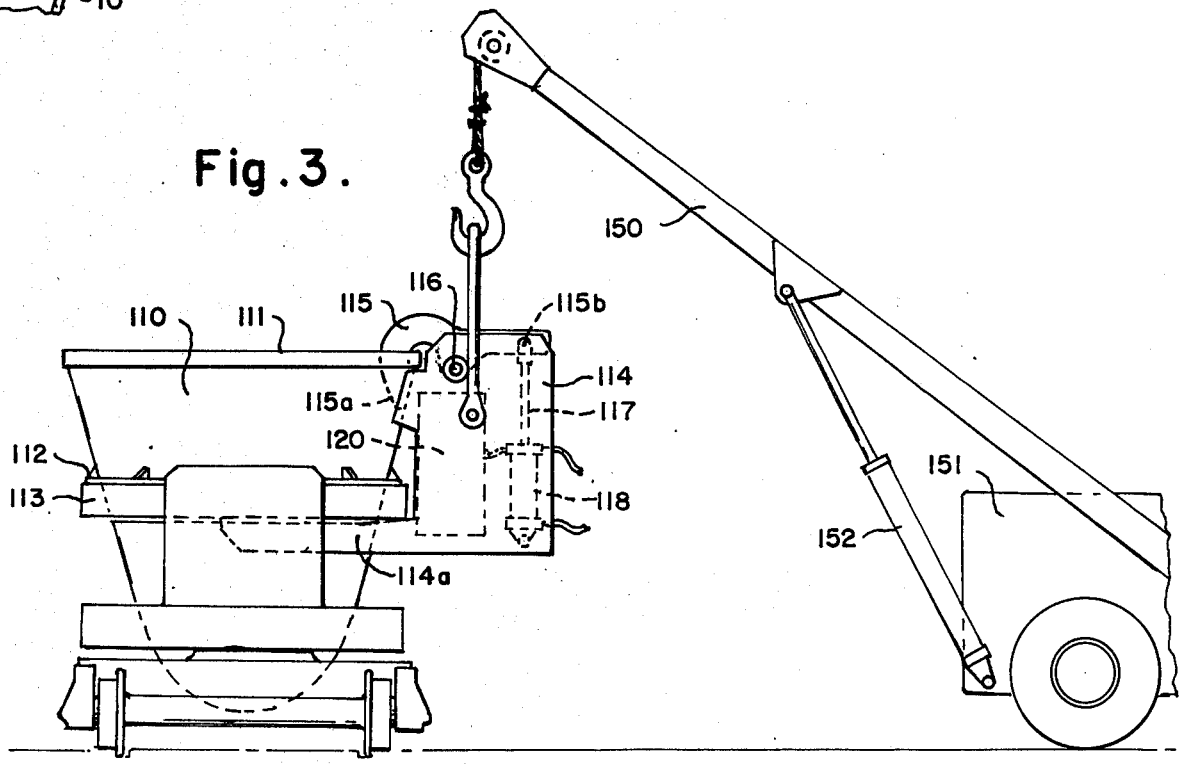
FIG. 3 is a side elevational view of a second embodiment of cleaning apparatus including a mobile power source.

In FIG. 3, I have illustrated a second embodiment of my invention in which I have illustrated a slag pot 110 having a top rim edge 111, a reenforcing and locking rim 112 and a carrying cradle 113. A clamping member housing 114 having at one end a clamp member 115 pivoted intermediate its ends on pin 116 and a yoke **114*a* adapted to partially surround the pot 110 and engage ring 112 on opposite sides spaced from clamp member 115. The clamp member 115 is provided at one end with a hook 115*a* adapted to engage the rim edge 111 of the slag pot and draw it tightly against housing 114 and at the other end with a pivot pin 115*b* engaged by hydraulic pistons 117 operated by cylinder 118. A vibratory assembly 120 operated by hydraulic fluid is mounted on housing 114 so that housing 114 and clamp member 115 transmit its vibratory effects to the rim edge 111 of slag pot 110. The vibratory element is preferably the same as described in connection with FIG. 1**.

The clamp 114 and yoke assembly **114*a* are carried on arms 150 extending from prime mover 151**. The arms 150 are moved vertically by means of hydraulic piston 152 in usual manner.

In the foregoing specification I have set out certain preferred embodiments and practices of my invention, however, it will be understood that this invention may be otherwise embodied within the scope of the following claims.

I claim:

1. An apparatus for cleaning metallurgical vessels such as slag pots, metal ladles, ingot molds, and the like having a separate carrier engaging said vessel intermediate its top and bottom comprising a housing, clamp means on said housing for engaging tightly over the top of the vessel to be cleaned, holding means on said housing for engaging said separate carrier and acting with said clamp means to hold the vessel and carrier against separation and vibratory means in the housing acting through the housing to induce vibratory motion in the vessel.

2. An apparatus as claimed in claim 1 wherein the clamp means is adapted to engage the rim edge of the vessel.

3. An apparatus as claimed in claim 1 wherein the vibratory means includes rotating eccentric weights.

4. An apparatus as claimed in claim 3 wherein the rotating eccentric weights are driven by hydraulic motors.

5. An apparatus as claimed in claim 4 wherein the clamp means is hydraulically operated sequentially with the hydraulic motors.

6. An apparatus as claimed in claim 3 wherein the eccentric weights are driven by electric motors.

7. An apparatus as claimed in claim 1 wherein the clamp means is a generally bell crank shaped arm pivoted intermediate its ends in said housing and one end is connected to a hydraulic cylinder for moving it pivotally and the other end engages the rim edge of the vessel to hold said rim edge fixedly between said arm and housing.

8. An apparatus for cleaning open top metallurgical vessels such as slag pots, ladles, ingot molds and the like having a separate carrier engaging said vessel intermediate its top and bottom comprising a mobile power source, clamp means extending from said power source for engaging over the top edge of said open top vessel to be cleaned, holding means on said power source for engaging said separate carrier and acting to hold said carrier and vessel together and vibratory means directly attached to said clamp to vibrate said vessel while attached to said clamp.

9. An apparatus as claimed in claim 8 having lift means on the power source lifting the clamp means and vessel while vibrating the vessel.

* * * * *